United States Patent [19]

King

[11] 3,996,819

[45] Dec. 14, 1976

[54] SOCKET WRENCH ATTACHMENT

[76] Inventor: James E. King, 805 Bernard Drive, Buffalo Grove, Ill. 60090

[22] Filed: Jan. 13, 1976

[21] Appl. No.: 648,784

Related U.S. Application Data

[63] Continuation-in-part of Ser. No. 306,153, Nov. 13, 1972, abandoned.

[52] U.S. Cl. ..... 81/121 R

[51] Int. Cl.[2] ..... B25B 13/06

[58] Field of Search ..... 81/53.2, 120, 121 R

[56] References Cited

UNITED STATES PATENTS

| | | | |
|---|---|---|---|
| 906,040 | 12/1908 | Lucas | 81/120 |
| 1,590,200 | 6/1926 | McGuckin | 81/120 |
| 3,161,090 | 12/1964 | McLellan | 81/120 X |

*Primary Examiner*—Al Lawrence Smith
*Assistant Examiner*—James G. Smith
*Attorney, Agent, or Firm*—Vincent A. Mallare

[57] ABSTRACT

A socket wrench attachment comprising a body, rotation means arranged at one end of the body for turning and rotating the body, a conical opening at the opposite end of the body, and a plurality of separate angularly rectilinear raised teeth circumferentially spaced on the interior surface of the conical opening, the raised teeth having a side tilted upward at a slight angle in the direction of rotation of the body and being spaced apart by an arc equal to about one-half that of each tooth.

3 Claims, 5 Drawing Figures

SOCKET WRENCH ATTACHMENT

CROSS REFERENCE TO RELATED APPLICATION

This application is a continuation-in-part of copending application, Ser. No. 306,153 filed Nov. 13, 1972 now abandoned.

BRIEF SUMMARY OF THE INVENTION

This invention relates to a socket wrench attachment for removing or turning a screw or nut of which, respectively, the screw-head or sides are disfigured and/or worn.

The screw-heads and nuts are generally disfigured by the slippage of a wrench or other tool in attempting to turn and remove the screws and nuts. The screw heads and nuts are worn or deteriorated when they are corroded and/or rusted by being exposed to corroding conditions such as in an engine, e.g., automobile engine, or the out-of-doors.

The present invention provides a socket wrench attachment for turning disfigured and/or worn screws or nuts. The present socket wrench comprises a body, a non-circular opening in one end of the body providing means for the insertion of a wrench handle drive means, a plurality of flat sides and corners on said end of said body providing drive means for an open-end wrench means, a conical opening in the opposite end of the body, and a plurality of separate angularly, rectilinear raised teeth circumferentially spaced on the interior surface of the conical opening, the raised teeth having a side tilted upward at a slight angle in the direction of rotation of the body and being spaced apart by an arc of about one-half that of each tooth.

DETAILED DESCRIPTION OF THE PREFERRED EMBODIMENTS OF INVENTION

Figure 1:
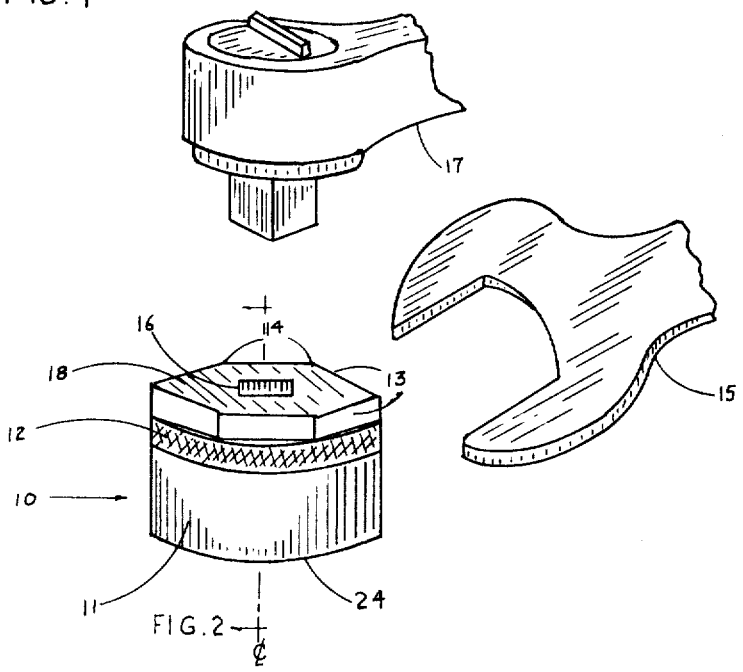
FIG. 1 is a perspective view of the exterior of a socket wrench attachment according to the present invention, illustrating drive means for rotation of the socket wrench attachment.

Referring to FIG. 1, a socket wrench attachment 10 according to the present invention is shown. As shown, the socket wrench attachment 10 comprises a body 11 of forged steel or other suitable material with a knurled or serrated fingergrip ring 12 machined on the body 11. On the exterior surface of the body 11 there is provided a plurality of flat sides 13 preferably even in number, forming corners 14 which provide gripping means for an open end, adjustable box or any suitable wrench means 15 to turn or rotate the socket wrench attachment 10.

Figure 2:
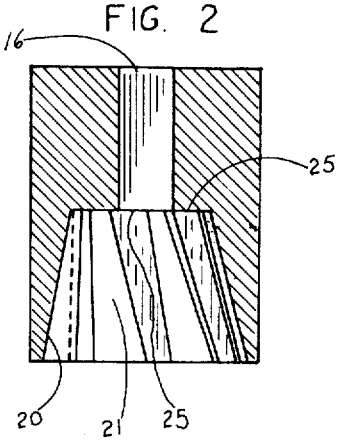
FIG. 2 is a longitudinal sectional of the socket wrench attachment illustrated in FIG. 1, taken along line 2—2.

As shown in both FIGS. 1 and 2, there is provided in one end, the top end 18 of the body 11 of the wrench attachment member 10, a non-circular opening 16. The opening 16 is arranged for the insertion of a standard socket wrench handle drive means 17 to turn or rotate the body 11 as needed to tighten or remove a screw or nut.

Figure 3:
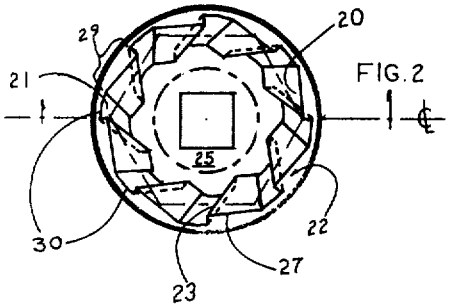
FIG. 3 is an end view of the socket wrench of FIG. 1, illustrating the conical opening and plurality of raised teeth arranged in that end of the socket wrench attachment of FIG. 1.

As shown particularly in FIG. 2 and in FIG. 3, there is provided in the end, i.e., the bottom end 24, opposite from that in which the non-circular opening 16 is, a conical opening 20 with an interior surface 21.

Referring specifically to FIG. 3, on the interior surface 21 of the conical opening 20 there are circumferentially spaced, a plurality of angularly rectilinear raised teeth 22. The raised teeth 22 each have an edge 23 and extend from the bottom end 24 to the abutement surface 25 as shown in FIG. 2.

Figure 4:
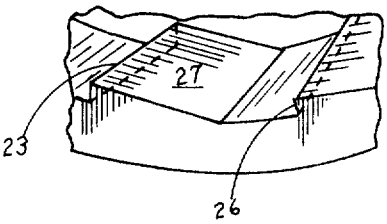
FIG. 4 is an enlarged partial view of the end view of the socket wrench attachment illustrated in FIG. 3.
Figure 5:
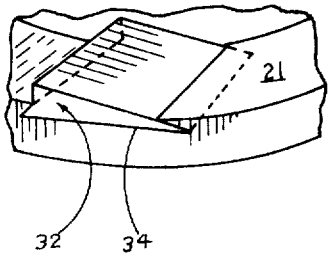
FIG. 5 is an enlarged partial end view of another embodiment of a socket wrench attachment according to the present invention.

As illustrated in FIGS. 3, 4 and 5, the angularly rectilinear raised teeth 22 are tilted or sloped at a slight angle upward in the direction of the rotation of the body 11. The raised teeth 22 have a short, leading side 26, and a long, sloping side 27 which form a right angle, i.e., 90° angle. The third side of the teeth 22 is curved in the form of an arc 29. The raised teeth 22 are circumferentially spaced around the interior surface 21 of the conical opening 20. The teeth 22 are separated by a space or arc 30 which is equal in length to about one-half of the length of the arc 29 of the raised teeth 22.

As shown in FIG. 3, where the body 11 is being rotated in a counterclockwise manner, the short side 26 of the teeth 22 is essentially perpendicular to the side of the conical opening 20 and corresponds to a diameter line of the opening 20. The short side 26 is the leading side in the direction of rotation.

According to the present invention, the number of teeth arranged around the interior surface 21 of the conical opening 20 should be an even number of teeth. There may be 6, 8 or 10 teeth arranged around the interior surface depending on the size of the teeth and wrench attachment. A socket wrench attachment having 8 teeth is preferred.

The socket wrench attachment may be made in various sizes depending on the type or screw-head that is intended to be turned or removed. The wrench attachment may be made out of any suitable material which is tough and resistant to wear, such as forged steel.

In FIG. 5 there is illustrated another embodiment of a socket wrench attachment according to the present invention. As shown, the teeth are formed as insert 32 which is placed and fixed in position in a corresponding slot or groove 34 formed in the interior surface 21 of the conical opening 20 of the body 11. With this embodiment, the teeth 32 may simply be removed and replaced with new teeth or removed and cleaned, and replaced in slot 34.

In the operation of the socket wrench attachment, the socket wrench body 11 with the conical opening 20 is placed over and around the nut or screw head to be turned. Then, the drive means 17 may be inserted into the non-circular opening 16 to turn the body in the direction of rotation desired. The open end wrench 15 may also be applied to the flat sides 14 to rotate the body 11. Accordingly, when unturning or removing a right hand threaded screw or nut, the body 11 is turned in a counterclockwise rotation.

When the body 11 is rotated with the conical opening 20 and teeth 22 engaged with the nut or screw head to be turned, the teeth 22 have two types of force-contact areas with the screw or nut being turned. As the body 11 is rotated in one direction, e.g., counterclockwise, the cutting edges 23 of the teeth 22 cut into the nut or screw head and as the body of the wrench attachment is rotated further, the sloping sides 27 of oppositely arranged teeth engage in contact with the flat sides of the nut or screw head being turned. By this action, there is the effect of a vice placed onto the screw head or nut to turn it in a counterclockwise motion.

As shown in FIG. 3, the two types of force-contacts made with the screw head or nut are the cutting edges 23 and sides 26 and 27 of the raised teeth. With this combination of types of force-contacts, a great force can be applied to a screw head or nut with the socket wrench attachment described above.

I claim:

1. A socket wrench attachment comprising a body, a non-circular opening at one end of said body providing means for insertion of a wrench handle drive means, a plurality of flat sides and corners on said body providing drive means for an open end wrench means, a conical opening in the opposite end of said body, and a plurality of separate angularly, rectilinear raised teeth circumferentially spaced on the interior surface of said conical opening, said teeth having a side tilted upward at a slight angle in the direction of rotation of the body and being spaced apart by an arc equal in length to about one-half that of each tooth.

2. A socket wrench attachment according to claim 1, wherein said raised teeth are removable inserts positioned in slots in the interior surface of said conical opening.

3. A socket wrench attachment according to claim 1, wherein said raised teeth have a short side and a long side which form a 90° angle.

* * * * *